United States Patent [19]

Winkowski

[11] Patent Number: 4,581,870

[45] Date of Patent: Apr. 15, 1986

[54] PAPER BATTENS

[75] Inventor: Daniel A. Winkowski, Tonawanda, N.Y.

[73] Assignee: National Gypsum Company, Dallas, Tex.

[21] Appl. No.: 407,138

[22] Filed: Aug. 11, 1982

[51] Int. Cl.[4] ..... B32B 3/04

[52] U.S. Cl. ..... 52/561; 428/58; 428/63; 428/126; 428/194; 428/343

[58] Field of Search ..... 428/40, 63, 84, 126, 428/124, 194, 202, 343; 52/562

[56] References Cited

U.S. PATENT DOCUMENTS 1,357,350 11/1920 Schumacher .
2,532,011 11/1950 Dahlquist et al. ..... 428/40
3,263,898 8/1966 Blish ..... 428/126 X

*Primary Examiner*—Alexander S. Thomas
*Attorney, Agent, or Firm*—Robert F. Hause

[57] ABSTRACT

Joints between predecorated gypsum wallboard concealed by relatively thin battens made of predecorated wallboard paper narrow strips with pressure-sensitive adhesive on the back, applied by mechanics using rolls of predecorated paper with adhesive and release paper on the back side of the predecorated paper.

6 Claims, 4 Drawing Figures

PAPER BATTENS

This invention relates to novel predecorated paper battens and walls or ceilings having such battens covering the joints between wallboards.

The mobile home industry uses large numbers of battens to cover joints between wall and ceiling panels. These battens are typically wood shapes that have been decorated by painting, printing, or laminating, and are normally applied with nails or staples.

Paper tape, supplied in roll form, about two inches wide, and referred to as joint tape, is commonly applied, with an aqueous joint cement under the tape and also over the tape, to completely conceal the joints of gypsum board in drywall construction. One of the earliest disclosures of this concealing of joints with joint tape to provide a monolithic surface with no irregularities is U.S. Pat. No. 1,357,350.

The present invention is directed to the use of a pressure-sensitive adhesively applied predecorated paper batten, having a pattern printed on the front surface which blends with a pattern on the wallboard, and having a front surface which is substantially flat and spaced outward from the plane of the wallboard front face. These paper battens are substantially lower in cost than wood battens, and substantially thinner. With a pressure-sensitive adhesive on the back, protected before use with release paper, the need of mechanical fasteners is avoided. The very low profile of a paper batten, compared with the thicker prior wood battens, acts together with the printed design which matches the wallboard design, to produce a relatively unnoticeable and thus aesthetically pleasing batten strip. The paper battens can be supplied in very long lengths, such as in rolls, whereby very little waste results when used in many varying length strips.

It is an object of this invention to provide a novel, low cost, easily applied predecorated batten strip.

It is a further object to provide an improved method of treating joints between predecorated wallboard.

It is a further object to provide a batten having greatly improved characteristics compared to anything previously available at a comparable price.

It is a still further object to provide an improved decorated wall.

These and other objects and advantages of the invention will be more readily apparent when considered in relation to the preferred embodiments as set forth in the specification and shown in the drawings in which.

Figure 1:
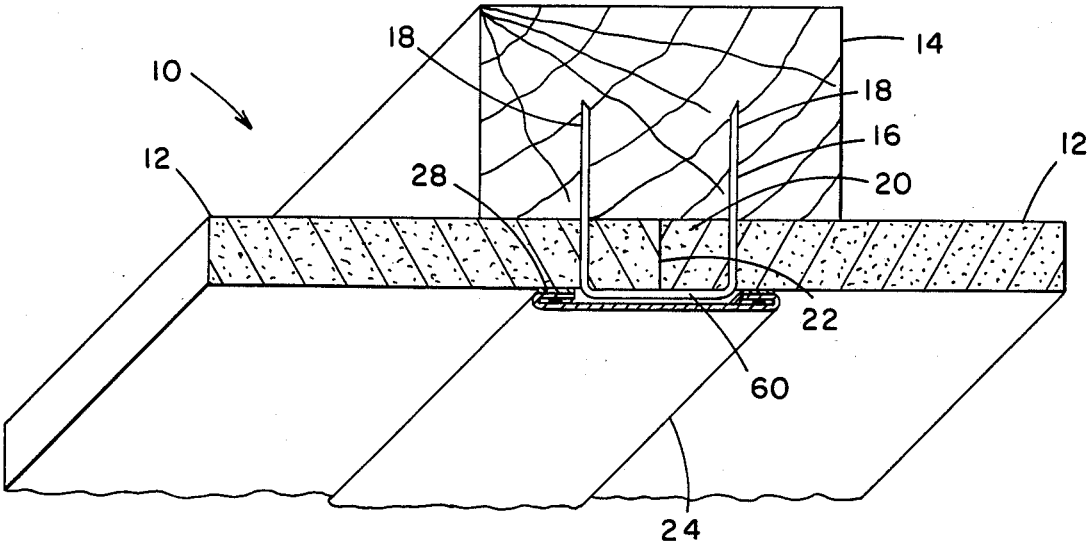
FIG. 1 is an end sectional isometric view of predecorated wallboards affixed to a framing member with a paper batten affixed over the joint between wallboards, in accordance with the invention.

Referring to FIG. 1 there is shown a wall 10, which may be a vertical wall or a ceiling. Wall 10 includes a plurality of predecorated gypsum wallboards 12, 12 affixed to framing members 14, only one being shown. Framing member 14 may be a vertically disposed stud if wall 10 is a vertical wall, or a horizontally disposed joist if wall 10 is a ceiling.

In the embodiment shown, the wallboards 12, 12 are affixed to framing member 14 with staples 16. Staples 16 each have two legs 18, 18, with one leg 18 extending through the edge portion 20 of one wallboard 12 and the other leg 18 extending through the edge portion 20 of an abutting wallboard 12. Both legs 18, 18 extend on into framing member 14, holding the wallboard firmly against the framing member 14.

Between the two wallboards 12, 12 there is a joint 22, which is located centered over the framing member 14. Centered over the joint 22, and extending parallel to joint 22, is a predecorated paper batten 24.

Figure 3:
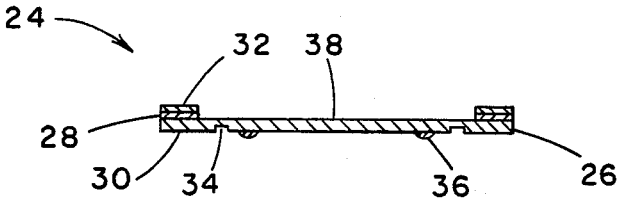
FIG. 3 is an end sectional view of the partially fabricated elements of the paper batten of FIG. 2.

As seen in FIG. 3, paper batten 24 is formed from a single, two-inch wide, elongate strip 26 of predecorated paper of about 0.015 inch thickness. The paper strip 26 has $\frac{1}{4}$ inch wide strips of acrylic water base pressure-sensitive adhesive 28 disposed along the top surface at each edge portion 30, and a $\frac{1}{4}$ inch wide strip of release paper 32 disposed atop each of the two strips of adhesive 28.

Figure 2:
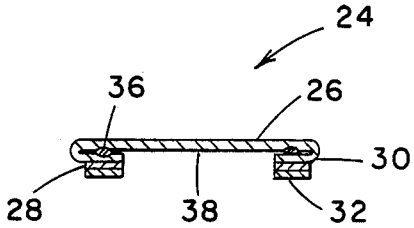
FIG. 2 is an end sectional view of the paper batten of FIG. 1, with release paper protecting the adhesive, prior to use.

On the bottom surface of strip 26, at $\frac{1}{4}$ inch in from each edge, there is a very small groove 34 for facilitating a subsequent folding of the two $\frac{1}{4}$ inch wide edge portions 30. During fabrication, two small elongate beads 36, 36 of adhesive are placed on the bottom surface of strip 26, one at each side, $\frac{1}{8}$ inch in from each groove 34. Each edge portion 30 is then folded under by a 180° fold, as shown in FIG. 2, and adhered to the center portion 38 by an adhesive bead 36.

The two-inch wide strip 26 predecorated paper is made by slitting a 54-inch wide jumbo roll of predecorated wallboard paper, and rewinding in numerous 2-inch wide rolls. The predecorated paper is preferably a printed, cream face paper having a strength and durability treatment of drying oil, as disclosed in U.S. Pat. No. 4,128,699. The treated paper is then printed with a design, using a process and apparatus similar to that used in the manufacture of paper or vinyl wallcoverings, with about 4 to 8 different colors of ink employed.

It will be understood that battens 24 can be produced in numerous different color combinations and different patterns, for use with predecorated wallboard having either identical colors and patterns, or compatible but different colors and/or designs.

The paper from which strips 26 is produced can also be slit and rewound in $1\frac{1}{2}$ inch wide rolls, which is then converted into a lower cost flat paper batten 50, consisting of narrower strips 52 of predecorated, drying oil treated paper with first a layer of pressure-sensitive adhesive 54 throughout the entire back face and a layer of release paper 56 disposed over the pressure-sensitive adhesive 54.

Figure 4:
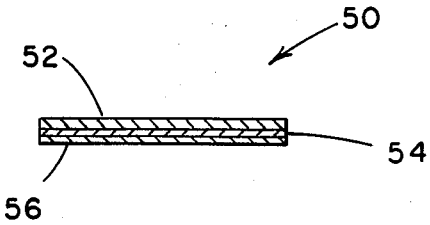
FIG. 4 is an end sectional view of a modified form of paper batten, in accordance with the invention.

Either paper batten 24 or paper batten 50 can be mounted over joints of predecorated wallboard by cutting a length thereof as desired, removing all of the release paper, and placing the paper batten centered over the wallboard joint. The paper batten is first placed lightly against the joint area of the boards and inspected for proper positioning. If not properly positioned, portions or all can be removed and replaced lightly against the joint area of the wallboards as many times as necessary until the positioning is proper. The paper battens are then tightly pressed onto the joint area of the wallboards with a small rigid roller or a firm brush. As will be seen in FIGS. 2 and 4, the battens 24 and 50 each have a flat front face with two outer opposite edge portions which are firmly held in fixed relation to the adhesive which is immediately thereunder holding the battens to wallboards 12, 12, and, thus, holding the entire face flat and in fixed parallel relation to the surfaces of wallboards 12, 12.

Paper battens 24 and paper battens 50 can also be placed along the top edge of predecorated wallboards of a vertical wall, with one side edge disposed against the adjacent ceiling.

The staple 16, shown in FIG. 1, is crowned staple, which has a head portion 60 projecting above the surface of the wallboards 12, 12. The crowned staple is commonly used in mobile home ceilings. Paper batten 24, with a raised center portion 38 is well adapted for use over crowned staples. Predecorated wallboards in walls of mobile homes are commonly affixed with staples which lie flush with the wallboard surface, and accordingly either paper battens 24 or paper battens 50 may be used successfully.

Having completed a detailed disclosure of the preferred embodiments of my invention so that those skilled in the art may practice the same, I contemplate that variations may be made without departing from the essence of the invention or the scope of the appended claims.

I claim:

1. A paper batten comprising a narrow paper strip having a substantially flat front face, a printed design on the front face, and a pressure-sensitive adhesive on the back face at least throughout all of the side edge portions thereof, said front face having two opposite edge portions which are in fixed relation to said pressure-sensitive adhesive thereunder, for holding said front face flat when fixed to the surfaces of wallboards, and said batten being formed from a flat strip of paper with narrow side portions folded inwardly against the back face.

2. A paper batten as defined in claim 1 wherein said paper is relatively stiff and has a thickness of about 0.015 inch.

3. A paper batten as defined in claim 1 with said pressure-sensitive adhesive disposed only on said folded narrow side portions.

4. A predecorated wall comprising a plurality of predecorated wallboards having edge portions forming a joint therebetween and an elongate paper batten, as defined in claim 1, adhesively disposed over at least some of said joints, said printed design on said paper batten being aesthetically compatible with the decoration on said predecorated wallboards and said batten front face being held in fixed parallel relation to the surfaces of said wallboards.

5. A predecorated wall as defined in claim 4 wherein said wall is a horizontal ceiling, with wallboards affixed to joists with crowned staples, said paper battens including narrow side portions folded inwardly to form a thin central portion of batten disposed over said crowned staples.

6. A method of erecting a decorative wall comprising the steps of affixing a plurality of predecorated wallboards to building framing members, with said wallboards forming elongate narrow joints therebetween, and concealing at least some of said joints by adhesively affixing paper battens, as defined in claim 1, over said joints.

* * * * *